US008995698B2

(12) United States Patent
Bartunek

(10) Patent No.: US 8,995,698 B2
(45) Date of Patent: Mar. 31, 2015

(54) VISUAL SPEECH MAPPING

(75) Inventor: Joshua Elliot Bartunek, Chanhassen, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 384 days.

(21) Appl. No.: 13/560,036

(22) Filed: Jul. 27, 2012

(65) Prior Publication Data

US 2014/0029778 A1 Jan. 30, 2014

(51) Int. Cl.
*H04R 25/00* (2006.01)

(52) U.S. Cl.
CPC ..... *H04R 25/30* (2013.01); *H04R 25/407* (2013.01); *H04R 25/43* (2013.01); *H04R 25/505* (2013.01); *H04R 25/55* (2013.01); *H04R 25/70* (2013.01); *H04R 2225/43* (2013.01)
USPC ..... 381/312; 381/60; 381/317

(58) Field of Classification Search
USPC ..... 381/58, 60, 312, 314, 317, 320, 321; 600/559; 704/226, 260, 270, 275
See application file for complete search history.

(56) References Cited

U.S. PATENT DOCUMENTS 6,574,342 B1 * 6/2003 Davis et al. ..... 381/314
7,206,416 B2 * 4/2007 Krause et al. ..... 381/60
7,564,979 B2 * 7/2009 Swartz ..... 381/60
2005/0086058 A1 4/2005 Lemelson et al.
2005/0251224 A1 11/2005 Berg
2010/0232613 A1 9/2010 Krause et al.
2012/0140937 A1 6/2012 Poe et al.

OTHER PUBLICATIONS

"European Application Serial No. 13178045.4, Extended European Search Report mailed Oct. 25, 2013", 7 pgs.
Moore, Brian, "The Value of Speech Mapping in Hearing-Aid Fitting", Retrieved from the Internet<URL:http://www.otometrics.com/~/media/DownloadLibrary/Otometrics/PDFs/Knowledge%20center%20content/Fitting%20content/speech-mapping-hearing-aid-fitting.pdf>, (Aug. 2006), 4 pgs.
"European Application Serial No. 13178045.4, Examination Notification Art. 94(3) mailed Sep. 5, 2014", 4 pgs.
"European Application Serial No. 13178045.4, Response filed Jul. 25, 2014 to Extended European Search Report mailed Oct. 25, 2013", 12 pgs.

* cited by examiner

*Primary Examiner* — Huyen D Le
(74) *Attorney, Agent, or Firm* — Schwegman Lundberg & Woessner, P.A.

(57) ABSTRACT

Described herein are an apparatus and method for displaying the signal processing effects of a hearing upon speech. Such visual speech mapping may include displaying text corresponding to words spoken to a patient wearing a hearing aid as derived from an input signal derived from the hearing aid. The text is displayed with indicia representing the effects of the signal processing function performed by the hearing aid upon individual letters or groups of letters.

22 Claims, 7 Drawing Sheets

VISUAL SPEECH MAPPING

FIELD OF THE INVENTION

This invention pertains to devices and methods for treating hearing disorders and, in particular, to electronic hearing aids.

BACKGROUND

Hearing aids are electronic instruments worn in or around the ear that compensate for hearing losses by amplifying sound. Because hearing loss in most patients occurs non-uniformly over the audio frequency range, most commonly in the high frequency range, hearing aids are usually designed to compensate for the hearing deficit by amplifying received sound in a frequency-specific manner. Adjusting a hearing aid's frequency specific amplification characteristics to achieve a desired optimal target response for an individual patient is referred to as fitting the hearing aid. One way to determine the optimal target response of the hearing aid is by testing the patient with a series of audio tones at different frequencies. The hearing deficit at each tested frequency can be quantified in terms of the gain required to bring the patients hearing threshold to a normal value.

Fitting a hearing aid by threshold testing discrete tones, however, is not entirely satisfactory. Since it is practical to threshold test at only a few discrete frequencies, the frequency response of the hearing aid is adjusted only at those frequencies. Sounds in the real world such as speech, however, are complex waveforms whose components may vary more or less continuously over a relatively wide range in the frequency domain. Modern digital hearing aids also incorporate signal processing functions such as noise reduction and frequency translation in order to provide better compensation for a particular patient's hearing loss. It would be desirable to provide the patient with information reflective of how the hearing aid is processing sound so that hearing aid parameters can be adjusted during the fitting process using feedback from the patient.

DETAILED DESCRIPTION

Described herein are an apparatus and method for visual speech mapping that allows users to actually see how a hearing aid is impacting speech. Rather than simply showing a graph representing the input signal as well as the gain applied to the input signal, the described system utilizes "speech-to-text" technology to show the spoken words on a display as streaming text as the words are spoken. A "before" view of the text may show how certain words or portions of words are expected to be affected by a particular patient's hearing deficit. For example, the text may be displayed with visual indications of how certain spoken vowels and consonants of text fall below the patient's hearing threshold or are affected by noise. An "after" portion of the text may show the same words but with indications of how the hearing aid is modifying the sounds of different letters. For example, letters corresponding to amplified portions of the input sound may be indicated with exaggerated sizes or capital letters. The noise floor can be shown as being reduced by displaying a background that gives more visual definition to certain letters. Frequency translation operations can be represented by different colors for letters corresponding to sounds or features that have been shifted in frequency. As discussed below, many variations on this concept are possible to indicate how the hearing aid affects speech.

System Description

Figure 1:
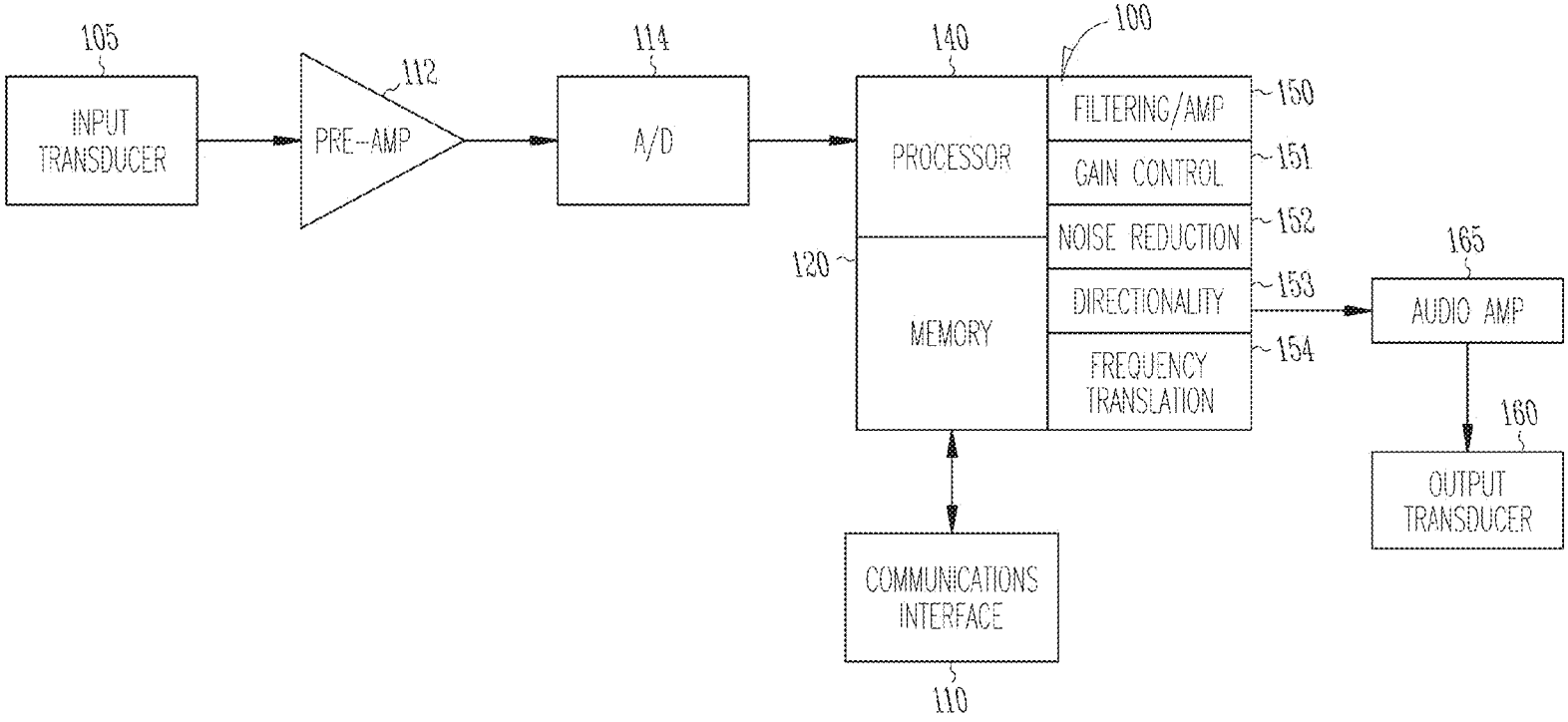
FIG. 1 is a block diagram of the components of an example hearing aid.

The electronic circuitry of a typical hearing aid is contained within a housing that is commonly either placed in the external ear canal or behind the ear. Transducers for converting sound to an electrical signal and vice-versa may be integrated into the housing or external to it. The basic components of an example hearing aid are shown in FIG. 1. A microphone or other input transducer 105 receives sound waves from the environment and converts the sound into an input signal. In certain embodiments, the input transducer 105 may comprise multiple microphones. After amplification by pre-amplifier 112, the input signal is sampled and digitized by A/D converter 114 to result in a digitized input signal IS. Other embodiments may incorporate an input transducer that produces a digital output directly. The device's signal processing circuitry 100 processes the digitized input signal IS into an output signal OS in a manner that compensates for the patient's hearing deficit. The output signal OS is then passed to an audio amplifier 165 that drives an output transducer 160 for converting the output signal into an audio output, such as a speaker within an earphone.

In the embodiment illustrated in FIG. 1, the signal processing circuitry 100 includes a programmable controller made up of a processor 140 and associated memory 120 for storing executable code and data. The overall operation of the device is determined by the programming of the controller, which programming may be modified via a communications interface 110. The signal processing circuitry 100 may be implemented in a variety of different ways, such as with an integrated digital signal processor or with a mixture of discrete analog and digital components. For example, the signal processing may be performed by a mixture of analog and digital components having inputs that are controllable by the controller that define how the input signal is processed, or the signal processing functions may be implemented solely as code executed by the controller. The terms "controller," "module," or "circuitry" as used herein should therefore be taken to encompass either discrete circuit elements or a processor executing programmed instructions contained in a processor-readable storage medium.

The communications interface 110 allows user input of data to a parameter modifying area of the memory 120 so that parameters affecting device operation may be changed as well as retrieval of those parameters. The communications interface 210 may communicate with a variety of devices such as an external programmer via a wired or wireless link.

The signal processing modules 150-154 may represent specific code executed by the controller or may represent additional hardware components. The filtering and amplifying module 150 amplifies the input signal in a frequency specific manner as defined by one or more signal processing parameters specified by the controller. The patient's hearing deficit may compensated by selectively amplifying those frequencies at which the patient has a below normal hearing threshold. Other signal processing functions may also be performed in particular embodiments. The gain control module 151 dynamically adjusts the amplification in accordance with the amplitude of the input signal. Compression, for example, is a form of automatic gain control that decreases the gain of the filtering and amplifying circuit to prevent signal distortion at high input signal levels and improves the clarity of sound perceived by the patient. Other gain control circuits may perform other functions such as controlling gain in a frequency specific manner. The noise reduction module 152 performs functions such as suppression of ambient background noise and feedback cancellation. The directionality module 153 weights and sums the output signals of multiple microphones in a manner that preferentially amplifies sound emanating from a particular direction (e.g., from in front of the patient). The frequency translation module 154 maps parts of the input sound signal or features extracted from the input sound signal from one frequency band to another. For example, sounds having high frequency components that are inaudible to a patient with high-frequency hearing loss (e.g., the "s" sound) may be translated to a lower frequency band that the patient is able to hear.

The programmable controller specifies one or more signal processing parameters to the filtering and amplifying module and/or other signal processing modules that determine the manner in which the input signal IS is converted into the output signal OS. The one or more signal processing parameters that define a particular mode of operation are referred to herein as a signal processing parameter set. A particular signal processing parameter set may, for example, define the frequency response of the filtering and amplifying circuit, define the manner in which noise reduction is performed, how multi-channel inputs are processed (i.e., directionality), and/or how frequency translation is to be performed.

Figure 2:
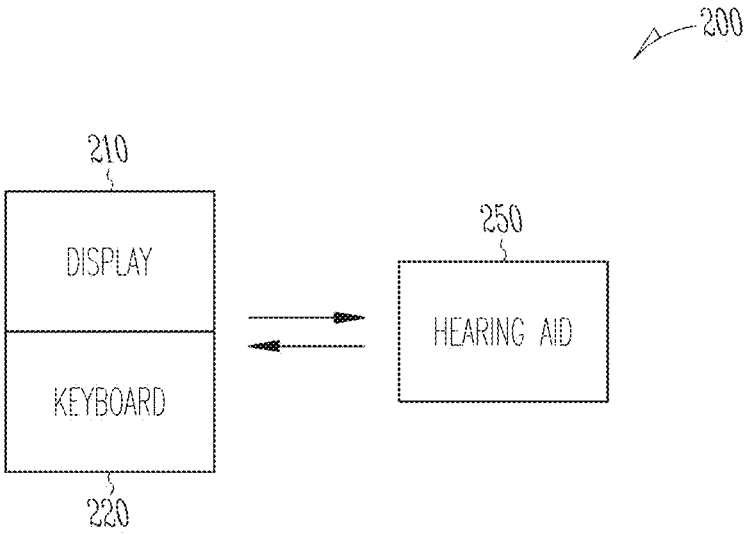
FIG. 2 illustrates an example system for visual speech mapping.

FIG. 2 illustrates an example system for visual speech mapping that includes a mapping processor 200 in communication with a hearing aid 250. The mapping processor 200 may in some embodiments, for example, be an appropriately programmed laptop computer with necessary hardware for communicating with the communications interface of the hearing aid using a wired or wireless communications link. In some embodiments, rather than communicating with the hearing aid directly, the mapping display may communicate with an external programmer that is in communication with the hearing aid. The mapping processor in this embodiment includes a display 210 and a keyboard 220. The input signal IS produced in the hearing aid is transmitted via the communications link to the mapping processor along with the parameter set used by the signal processing circuitry to generate the output signal OS. As words are spoken within range of the hearing aid, a speech recognition program executed by the mapping processor processes the input signal IS received from the hearing aid to generate text corresponding to the spoken words. The text may be displayed as is and/or with indications as to how the patient would perceive the speech with no hearing aid, where the hearing response of the patient as determined from clinical testing is input to the mapping processor. The text may also be displayed with indications as to how the signal processing circuitry of the hearing aid would modify the spoken words using the parameter set received from the hearing aid. As discussed below, the indications displayed with the text as to how the patient would hear the words with or without the hearing aid may take various forms. By displaying the text corresponding to the spoken words in these manners, the patient is able to provide feedback to a clinician operating the mapping processor to adjust the parameter set of the hearing aid via the communications link.

Figure 3:
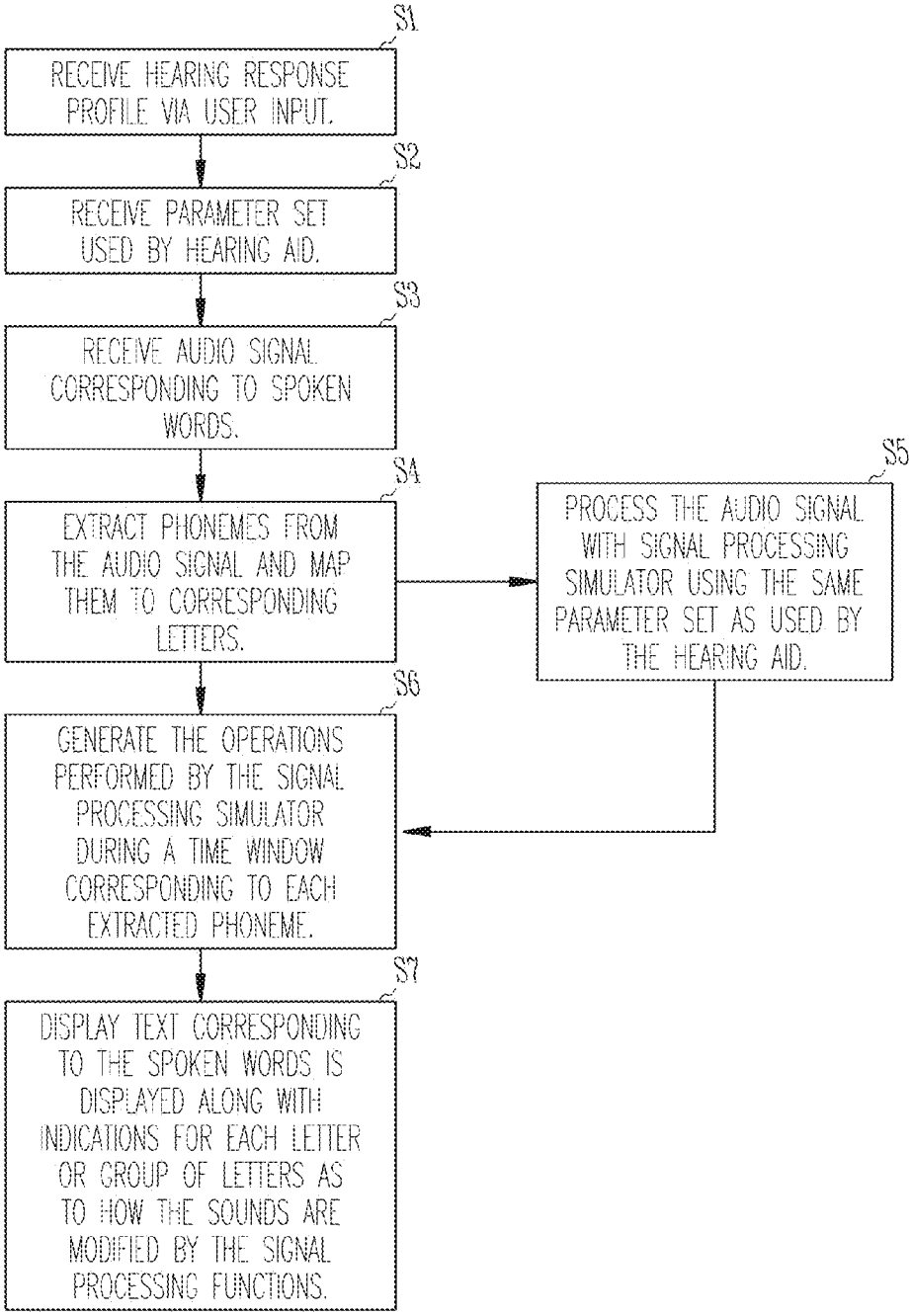
FIG. 3 is a block diagram of an example procedure executed by the mapping processor to create a visual speech display.

FIG. 3 is a high-level block diagram of the procedures that may be used by the mapping processor in carrying out the above-described functions. At step S1, the hearing response profile of a particular patient is received via user input. At step S2, the current parameter set used by the hearing aid for signal processor is received via the communications link. At step S3, as words are spoken to the patient wearing the hearing aid, the digitized input signal generated by the hearing aid, before further signal processing is performed, is received via the communications link. Alternatively, the audio signal corresponding to the spoken words are generated by a microphone external to the hearing aid. For example, the input signal may be generated by a microphone may be placed near the patient to approximate what the hearing aid is receiving. At step S4, a speech recognition program extracts phonemes from the input signal and maps them to corresponding letters. Concurrently, at step S5, a signal processing simulator also executed by the mapping processor processes the input signal using the same parameter set as used by the hearing aid. The operations performed by the signal processing simulator during a time window corresponding to each extracted phoneme (e.g., amplification, noise reduction, directionality processing, and/or frequency translation) are generated by the signal processing simulator at step S6. At step S7, the text corresponding to the spoken words is displayed along with indications for each letter or group of letters as to how the sounds are modified by the signal processing functions. The text may also be displayed without any modifications and/or along with indications as to how the patient would hear the words without the hearing aid.

Example Displays

Figure 4:
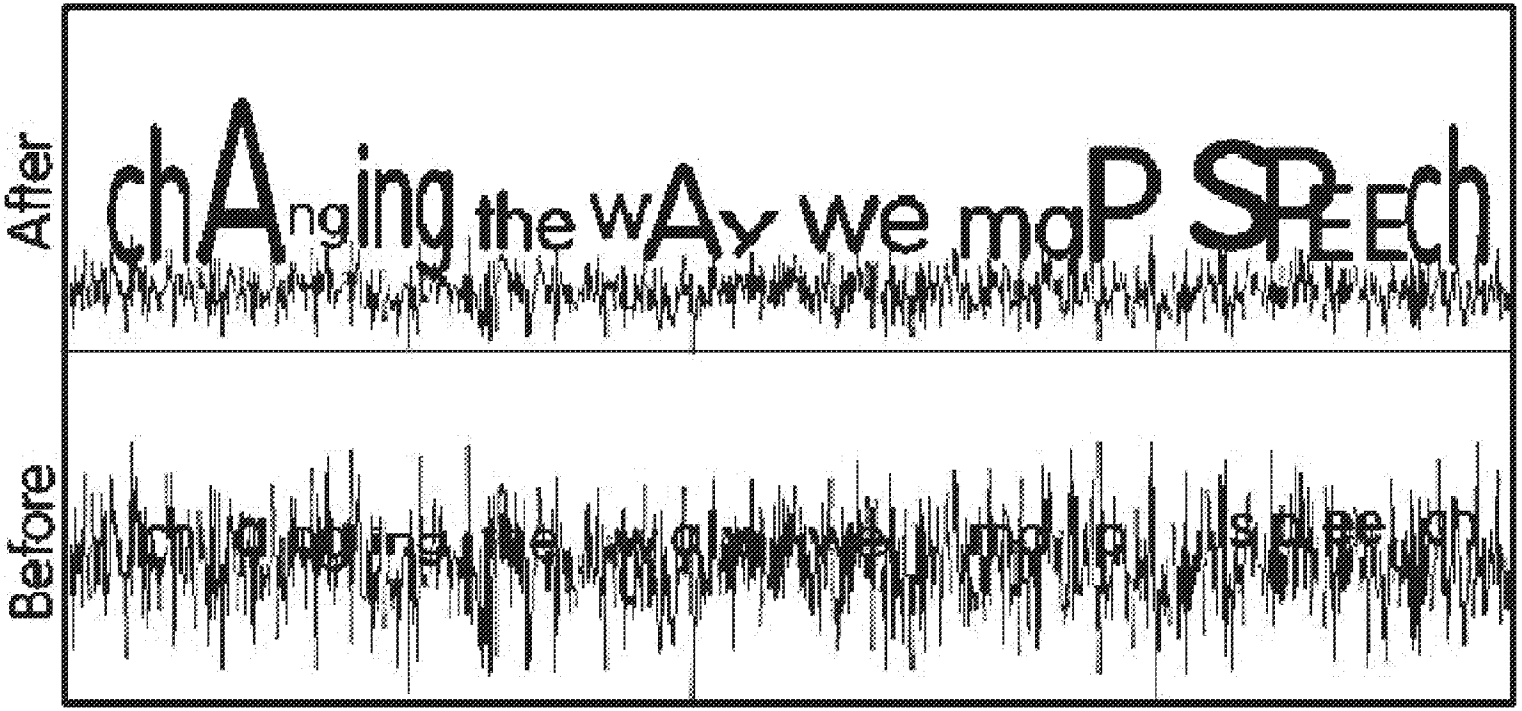
FIG. 4 show an example of visual speech mapping with frequency specific amplification applied to the speech.

The indications displayed with the text that indicate either how the patient would hear the speech without a hearing aid or how signal processing of the hearing aid affects the speech may take various forms. For example, letters or groups of letters may be displayed with indicia such as different typefaces, sizes, shadings, colors, and/or backgrounds to indicate how the speech is affected by either the patient's own hearing deficit or the signal processing of the hearing aid. Which of the indicia are used to represent which of the effects on the speech by the patient's hearing deficit or the signal processing of the hearing aid may be selected as desired. FIG. 4 illustrates an example of some text corresponding to spoken words as they could be displayed by the mapping processor. The "Before" view shows how certain words or portions of words fall below the hearing threshold of patient according to the particular hearing deficit and/or the noise threshold. The "After" view shows the same words but with exaggerated sizes or capital letters when equalization and compression are applied to the sounds and with different colors to show when frequency translation is applied.

Figure 5A:
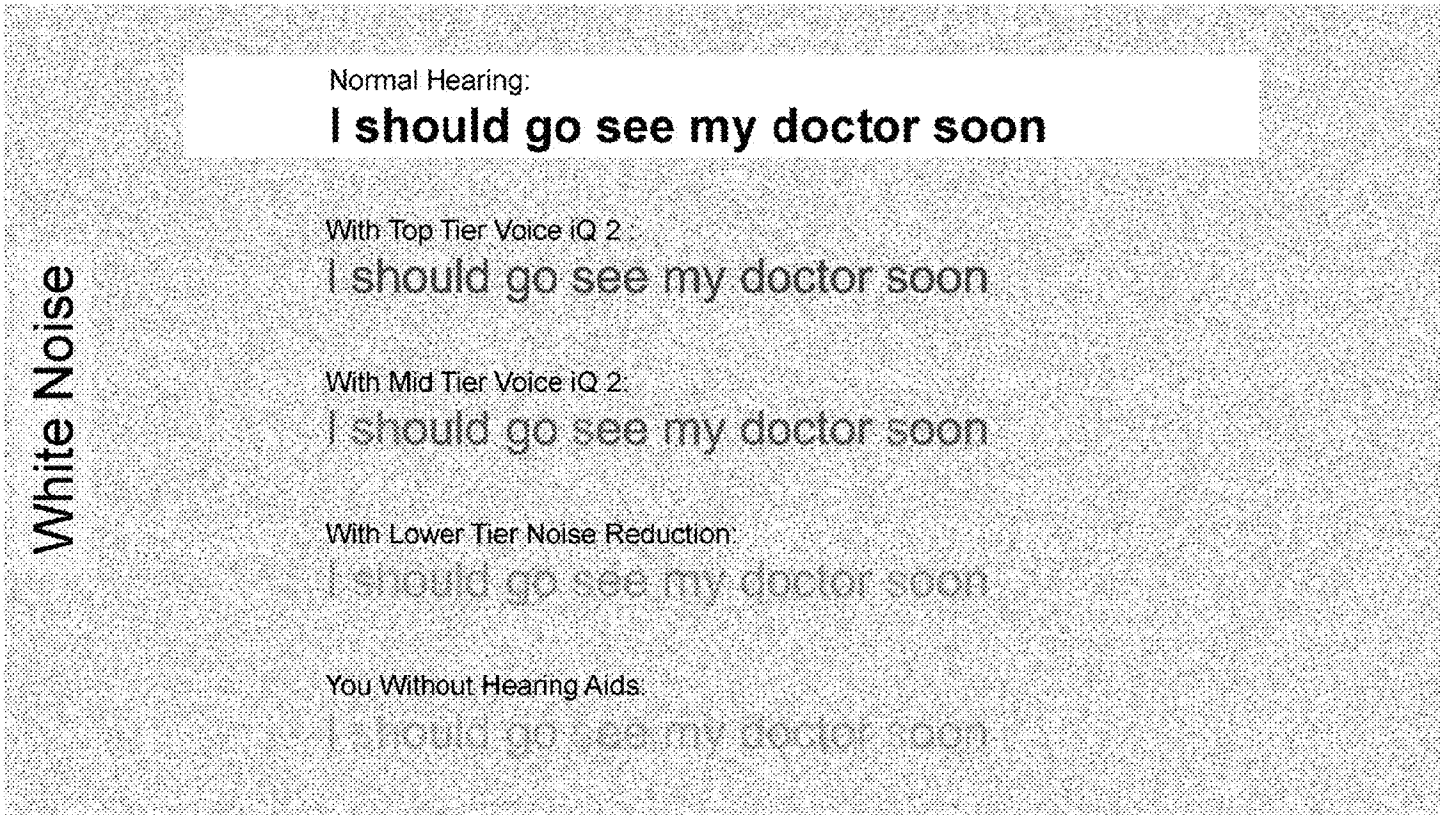
FIGS. 5A through 5C show examples of visual speech mapping with frequency specific amplification, noise reduction, frequency translation, and directional processing applied to the speech.
Figure 5B:
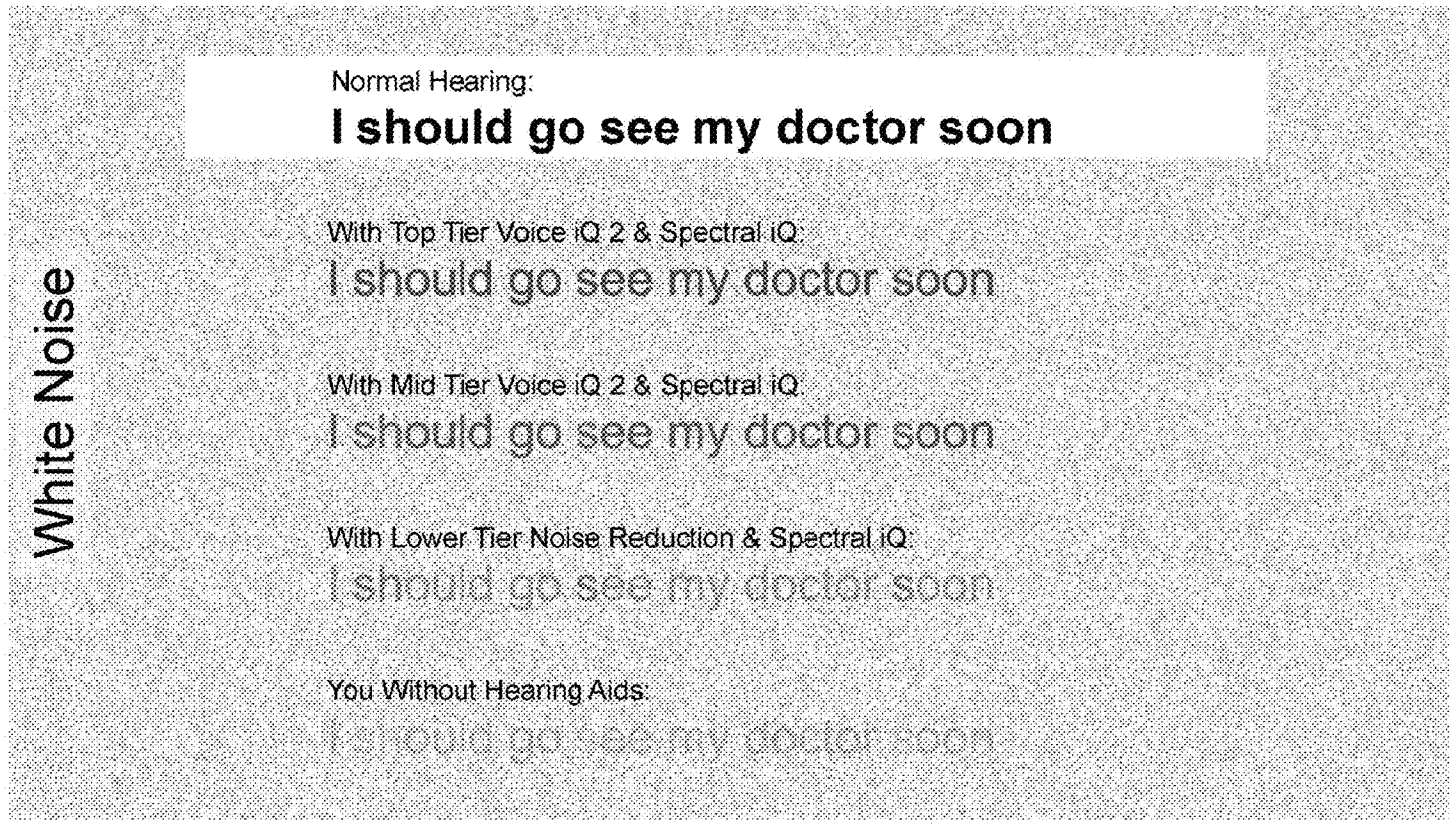
Figure 5C:
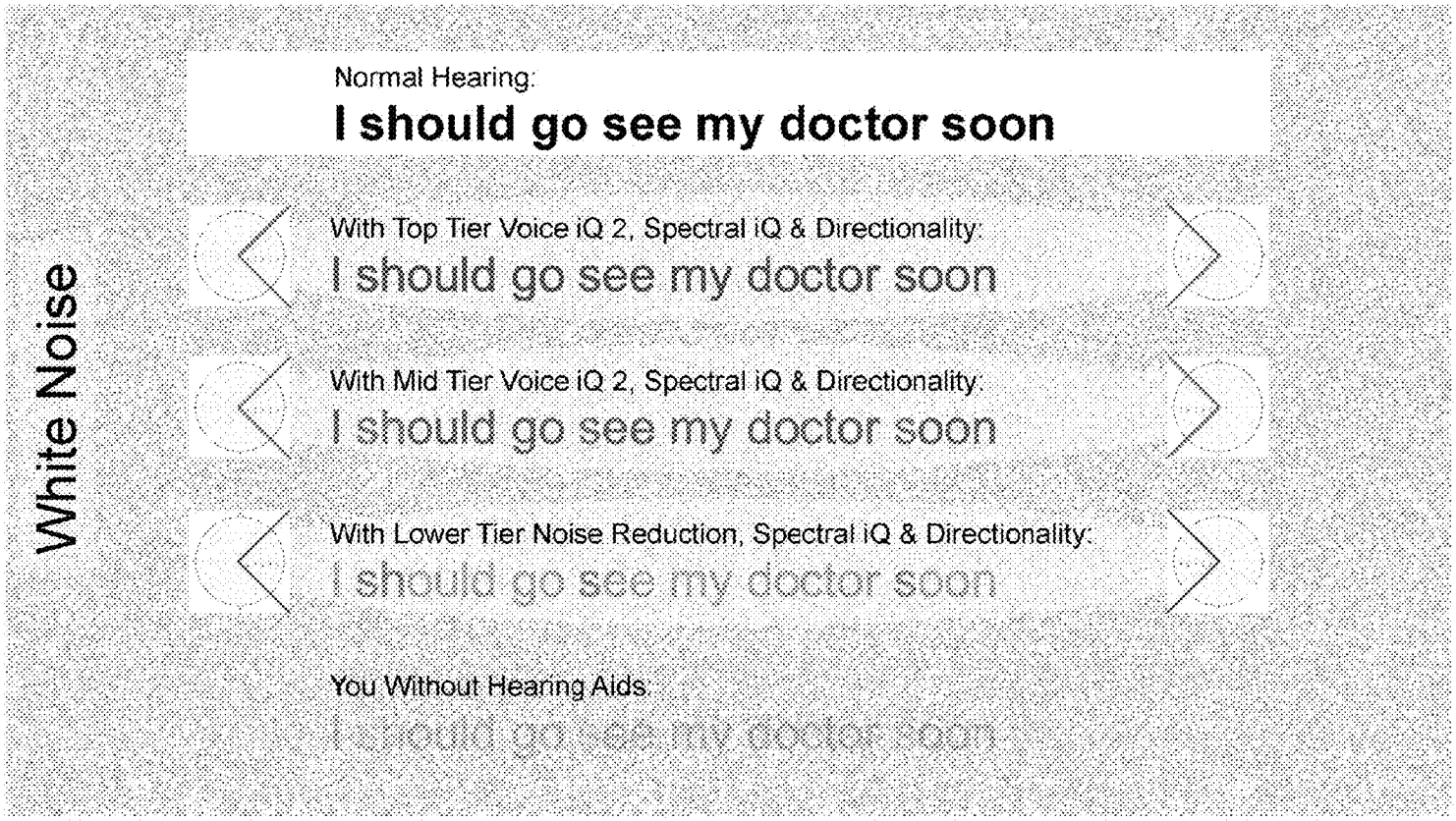

FIGS. 5A through 5C show further examples of visual speech mapping as described above. The background of each figure upon which the displayed texts are superimposed in intended to represent ambient noise. Each of the figures also shows at the top and bottom lines a display of the text intended to represent normal hearing and the hearing of the patient, respectively.

Referring first to FIG. 5A, the first line from the bottom displays the text with bolder face for some of the letters used as indicia of how the speech would be heard by the patient when the signal processing circuitry of the hearing aid applies a first level of noise reduction. The second and third lines from the bottom display the text where still bolder faces are used for some of the letters to represent increasing levels of frequency-specific amplification. FIG. 5B is similar to FIG. 5A but with certain letters having indicia to show the application by the hearing aid of frequency translation to compensate for the patient's hearing deficit. The letters "s" and "sh" in the displayed text are spoken with a higher frequency content than the other letters and may be colored differently (e.g., colored red) from the other letters or otherwise distinguished by shading or typeface to show the application of frequency translation. FIG. 5C is similar to FIG. 5B but also graphically depicts the application by the hearing aid of directional processing to the spoken speech using icons to represent the directionality.

Example Embodiments

In a first embodiment, a method includes: having selected words spoken to a patient wearing a hearing aid; receiving the input signal generated by the hearing aid before application of compensatory signal processing; employing a speech recognition algorithm to generate text from the received input signal that corresponds to the selected spoken words; receiving a parameter set from the hearing aid that defines one or more compensatory signal processing performed by the hearing aid; and displaying the text along with indicia representing the effects of the one or more compensatory signal processing functions on particular letters or groups of letters. The method may include programming the parameter set of the hearing aid based upon feedback from the patient regarding the displayed text.

In a second embodiment, an apparatus, comprises: circuitry for receiving an input signal generated by a hearing aid when words are spoken before application of compensatory signal processing and for receiving a parameter set from the hearing aid that defines one or more compensatory signal processing performed by the hearing aid; circuitry for employing a speech recognition algorithm to generate text from the received input signal that corresponds to the spoken words; circuitry for determining the extent to which the one or more compensatory signal processing functions affect particular letters or groups of letters of the generated text; and, a display for displaying the generated text along with indicia representing the effects of the one or more compensatory signal processing functions on particular letters or groups of letters. In either of the first or second embodiments, rather than receiving the input signal generated by the hearing aid before application of compensatory signal processing, the audio signal corresponding to the spoken words may generated by a microphone external to the hearing aid.

In a third embodiment, a method comprises: receiving a hearing response profile reflective of a patient's hearing deficit; generating a parameter set that defines one or more compensatory signal processing as could be performed by a hearing aid to compensate for the patient's hearing deficit; and, displaying a sample of text along with indicia representing the effects of the one or more compensatory signal processing functions as defined by the generated parameter set on particular letters or groups of letters. In a fourth embodiment, an apparatus comprises: circuitry for receiving a hearing response profile reflective of a patient's hearing deficit; circuitry for generating a parameter set that defines one or more compensatory signal processing as could be performed by a hearing aid to compensate for the patient's hearing deficit; and, a display for displaying a sample of text along with indicia representing the effects of the one or more compensatory signal processing functions as defined by the generated parameter set on particular letters or groups of letters. For example, a laptop or other type of computer may be programmed to receive a particular patient's hearing response profile or audiogram obtained from clinical testing or simply an example hearing response profile for demonstration purposes. A parameter set generation program then interprets the hearing response profile to generate the parameter set that defines the one or more compensatory signal processing functions. Alternatively, the parameter set could be generated by an operator after examining the hearing response profile. A signal processing simulator program uses the parameter set to generate one or more compensatory signal processing functions based upon a text sample. The signal processing program may use known audio characteristics of the letters in the text sample in generating the signal processing functions. A display program then displays the sample of text along with indicia representing the effects of the one or more compensatory signal processing functions that were generated by the signal processing simulator program on particular letters or groups of letters.

In any of the first, second, third, or fourth embodiments, the one or more compensatory signal processing functions may include frequency specific amplification, noise reduction, directional processing, and/or frequency translation. In either of the first or second embodiments, the indicia representing the effects of the one or more compensatory signal processing functions may include changing the typeface of the displayed text, changing the size of the displayed text, changing the color of the displayed text, changing the background upon which the displayed text is superimposed, and/or an icon representing directional processing.

The subject matter has been described in conjunction with the foregoing specific embodiments. It should be appreciated that those embodiments may also be combined in any manner considered to be advantageous. Also, many alternatives, variations, and modifications will be apparent to those of ordinary skill in the art. Other such alternatives, variations, and modifications are intended to fall within the scope of the following appended claims.

What is claimed is:

1. A method, comprising:

having selected words spoken to a patient wearing a hearing aid;

receiving the input signal generated by the hearing aid before application of compensatory signal processing;

employing a speech recognition algorithm to generate text from the received input signal that corresponds to the selected spoken words;

receiving a parameter set from the hearing aid that defines one or more compensatory signal processing performed by the hearing aid;

displaying the text along with indicia representing the effects of the one or more compensatory signal processing functions on particular letters or groups of letters.

2. The method of claim 1 wherein the one or more compensatory signal processing functions include frequency specific amplification.

3. The method of claim 1 wherein the one or more compensatory signal processing functions include noise reduction.

4. The method of claim 1 wherein the one or more compensatory signal processing functions include directional processing.

5. The method of claim 1 wherein the one or more compensatory signal processing functions include frequency translation.

6. The method of claim 1 wherein the indicia representing the effects of the one or more compensatory signal processing functions include changing the typeface of the displayed text.

7. The method of claim 1 wherein the indicia representing the effects of the one or more compensatory signal processing functions include changing the size of the displayed text.

8. The method of claim 1 wherein the indicia representing the effects of the one or more compensatory signal processing functions include changing the color of the displayed text.

9. The method of claim 1 wherein the indicia representing the effects of the one or more compensatory signal processing functions include changing the background upon which the displayed text is superimposed.

10. The method of claim 1 wherein the indicia representing the effects of the one or more compensatory signal processing functions include an icon representing directional processing.

11. An apparatus, comprising:

circuitry for receiving an input signal generated by a hearing aid when words are spoken before application of compensatory signal processing and for receiving a parameter set from the hearing aid that defines one or more compensatory signal processing performed by the hearing aid;

circuitry for employing a speech recognition algorithm to generate text from the received input signal that corresponds to the spoken words;

circuitry for determining the extent to which the one or more compensatory signal processing functions affect particular letters or groups of letters of the generated text;

a display for displaying the generated text along with indicia representing the effects of the one or more compensatory signal processing functions on particular letters or groups of letters.

12. The apparatus of claim 11 wherein the one or more compensatory signal processing functions include frequency specific amplification.

13. The apparatus of claim 11 wherein the one or more compensatory signal processing functions include noise reduction.

14. The apparatus of claim 11 wherein the one or more compensatory signal processing functions include directional processing.

15. The apparatus of claim 11 wherein the one or more compensatory signal processing functions include frequency translation.

16. The apparatus of claim 11 wherein the indicia representing the effects of the one or more compensatory signal processing functions include changing the typeface of the displayed text.

17. The apparatus of claim 11 wherein the indicia representing the effects of the one or more compensatory signal processing functions include changing the size of the displayed text.

18. The apparatus of claim 11 wherein the indicia representing the effects of the one or more compensatory signal processing functions include changing the color of the displayed text.

19. The apparatus of claim 11 wherein the indicia representing the effects of the one or more compensatory signal processing functions include changing the background upon which the displayed text is superimposed.

20. The apparatus of claim 11 wherein the indicia representing the effects of the one or more compensatory signal processing functions include an icon representing directional processing.

21. A method, comprising:

receiving a hearing response profile reflective of a patient's hearing deficit;

generating a parameter set that defines one or more compensatory signal processing functions as could be performed by a hearing aid to compensate for the patient's hearing deficit; and, displaying a sample of text along with indicia representing the effects of the one or more compensatory signal processing functions as defined by the generated parameter set on particular letters or groups of letters.

22. An apparatus, comprising:

circuitry for receiving a hearing response profile reflective of a patient's hearing deficit;

circuitry for generating a parameter set that defines one or more compensatory signal processing functions as could be performed by a hearing aid to compensate for the patient's hearing deficit; and, a display for displaying a sample of text along with indicia representing the effects of the one or more compensatory signal processing functions as defined by the generated parameter set on particular letters or groups of letters.

* * * * *